United States Patent [19]

Genovese

[11] Patent Number: 4,594,527

[45] Date of Patent: Jun. 10, 1986

[54] VACUUM FLUORESCENT LAMP HAVING A FLAT GEOMETRY

[75] Inventor: Frank C. Genovese, Fairport, N.Y.

[73] Assignee: Xerox Corporation, Stamford, Conn.

[21] Appl. No.: 539,492

[22] Filed: Oct. 6, 1983

[51] Int. Cl.[4] ..... H01J 1/62

[52] U.S. Cl. ..... 313/493; 313/495; 313/496

[58] Field of Search ..... 313/117, 495, 493, 496; 445/52; 355/68; 362/84, 97

[56] References Cited

U.S. PATENT DOCUMENTS

| | | | |
|---|---|---|---|
| 3,149,262 | 9/1964 | Skellett | 315/168 |
| 3,589,789 | 6/1971 | Hubert et al. | 445/52 |
| 4,020,386 | 4/1977 | Yasutome et al. | 313/496 |
| 4,413,903 | 11/1983 | Corona et al. | 355/68 |
| 4,417,184 | 11/1983 | Takesako et al. | 313/495 |

FOREIGN PATENT DOCUMENTS

| | | | |
|---|---|---|---|
| 69765 | 6/1981 | Japan | 313/496 |
| 56-73970 | 6/1981 | Japan . | |
| 158855 | 9/1983 | Japan | 313/495 |
| 58-154965 | 9/1983 | Japan . | |

*Primary Examiner*—S. Leon Bashore
*Assistant Examiner*—Michael K. Beyer

[57] ABSTRACT

A vacuum fluorescent lamp has a novel planar construction permitting it to be closely positioned to an object plane and hence, used as an efficient illuminator. The lamp is constructed so that the lamp surface interfacing the object plane is optically transparent so as to permit illumination to reach a scan illumination strip. The lamp surface opposite the interface surface has an optical window formed therein which permits light rays reflected from the document to exit the lamp along an optical path extending through the lamp.

1 Claim, 2 Drawing Figures

VACUUM FLUORESCENT LAMP HAVING A FLAT GEOMETRY

BACKGROUND AND PRIOR ART STATEMENT

The present invention relates to illumination sources for an electrophotographic reproduction device and, more particularly, to a vacuum fluorescent lamp utilized as a document exposure lamp.

Conventional illumination sources used in electrophotographic reproduction devices such as copiers and printers are typically cylindrical low pressure mercury vapor fluorescent lamps. These lamps generally have an excellent spectral match to the photoreceptor, are electrically efficient and moderate in cost. The lamps also have attendant disadvantages, however; the primary ones being temporal and spatial non-uniformity in illumination along the lamp axis, and slow turn-on time.

It is known in the art to utilize a fluorescent-type lamp in which the mercury is removed and a wire anode is disposed axially within the evacuated tube envelope to provide a source of electron emission. As disclosed in a Matsushita Patent Publication No. 56-73970, laid open on June 19, 1981, a glass tube, retained under high vacuum, has a phosphor coated anode extending axially along the tube interior, which when excited, and in conjunction with a control grid and tungsten filament wire, provides an efficient uniform light emission directed towards a surface to be illuminated. The particular configuration used permits a shorter lamp length to be used since there is absent the normal illumination end drop-off associated with conventional lamps. The power requirements are also reduced for this configuration.

U.S. Pat. No. 3,149,262 also discloses a vacuum fluorescent lamp which has a coating on its inner wall, a transparent conductive material upon which is formed a layer of cathode luminescent phosphor. Axially disposed within the lamp is a cathode metallic sleeve. The advantages of this type of lamp are described as faster starting and greater brillance.

These prior art vacuum fluorescent lamps have retained the cylindrical configuration characterizing the conventional fluorescent lamps. Because of this construction, adequate illumination of a document at an image plane is practically realized only by using two lamps, one on each side of an incremental scanning strip area. Alternatively, a single lamp on one side of the scan strip and a reflector on the opposite side provide the required illumination level.

The present invention is directed to a vacuum fluorescent lamp which has a flat geometry, e.g. the lamp envelope has a planar, rather than a cylindrical, surface. This permits the lamp to be placed in a closer location to an object to be illuminated then is possible with a tubular lamp, thereby increasing illumination efficiency. The lamp is also adapted to permit the document image to be viewed through the lamp itself.

More particularly, the invention is directed towards a document illumination device for illuminating a document at an object plane, the device comprising:

a vacuum fluorescent lamp having a planar envelope positioned in close proximity to said object plane, said lamp adapted to illuminate said object plane through an interfacing surface and to transmit a reflected object image through the lamp surface opposite said interfacing surface.

In a preferred embodiment, the lamp envelope has a rectangular configuration.

DRAWINGS

DESCRIPTION

Figure 1:
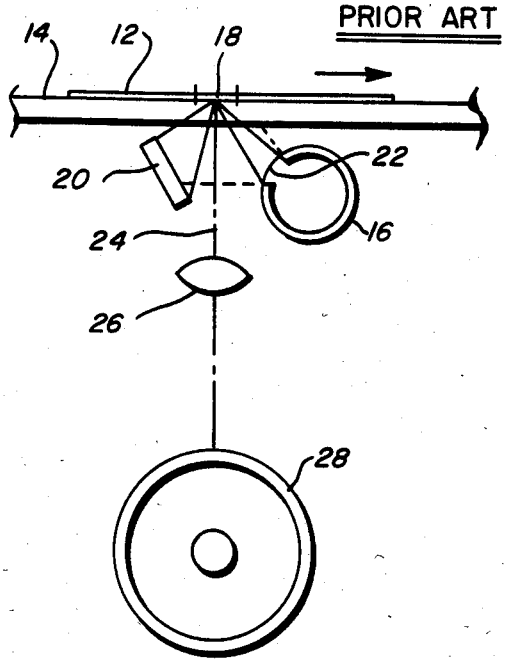
FIG. 1 PRIOR ART
FIG. 1 is a schematic end view of a prior art document illumination system utilizing a tubular fluorescent lamp and mirror.

Referring now to FIG. 1, there is shown a prior art document exposure system wherein a document 12 is placed on a movable transparent platen 14. A fluorescent lamp 16 is placed on one side of a scan strip 18, mirror 20 is placed on the other side of strip 18. As lamp 16 is energized, a first component of light from aperture 22 is directed towards scan strip 18 while a second component is directed to strip 18 from mirror 20. As the platen is moved through scan strip 18 (by means not shown), incremental linear segments of document 12 are illuminated. The imaged segments are reflected along optical path 24, and imaged through lens 26 onto a photosensitive drum 28. The drum moves in synchronism with the platen forming a latent image of the document upon the drum surface as is known in the art.

The disadvantages of this type of exposure system are that, because of the diameter of lamp 16, it must be placed an appreciable distance from platen 14, thereby lowering efficiency. A second disadvantage is the need to use an associated mirror 20 in order to direct sufficient illumination to scan strip 18. These disadvantages are overcome by replacing lamp 16 and mirror 20 by the vacuum fluorescent lamp shown in FIG. 2.

Figure 2:
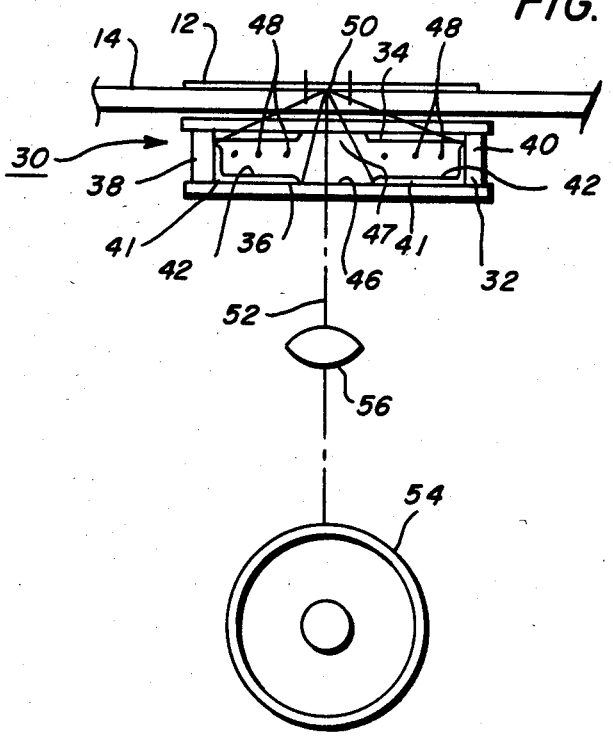
FIG. 2 is a schematic end view of a flat vacuum fluorescent lamp utilized, according to the invention, as a document illumination device.

Referring to FIG. 2, elongated, rectangular lamp 30 is positioned with the larger dimension extending into the page. The top surface of the lamp is placed directly adjacent the bottom of platen 14. Lamp 30 consists of a rectangular glass frame 32 having a top surface 34, bottom surface 36 and side surfaces 38, 40. The interior of the tube is retained under a vacuum of about $10^{-8}$ to $10^{-12}$ Torr. A conductive layer of material 41 is applied to the interior surfaces of the lamp except for at least a portion of surface 34 and from a portion of surface 36. A phosphor layer 42 is coated over conductive layer 41. Optical windows 46 and 47, formed by omitting the conductive and phosphor layer, is therby rendered transmissive to light. A plurality of cathode filaments 48 are centrally located within the lamp and are connected at the lamp ends to an appropriate lamp energization source.

Upon application of appropriate power to the cathode filaments, the filaments emit electrons which strike the phosphor layer causing luminescence and thereby providing a high level of illumination at the scan strip 50 area. Light reflected from scan strip 50 is reflected back through lamp 30 exiting through optical window 46. The scanned line images are thus transmitted along optical path 52 and focused onto drum 54 by lens 56.

In an exemplary embodiment, a glass envelope is coated, on the interior wall thereof, with a thin conductive layer 41 of tin oxide. Phosphor layer 42 is a high efficiency matched P22 phosphor of the type used in color TV tubes. Cathode filaments 48 are tensioned tungsten wire ½ to 1-½ mil diameter coated electrophoretically with a Ba/Sr/CA oxide mixture available from Transeve Co. Power requirements are met by a 200–500 anode voltage source at several ma and a filament heating source of approximately 5 volts at 150 ma.

In conclusion, it may be seen that there has been disclosed an improved illumination device utilizing a vacuum fluorescent lamp. The exemplary embodiment described herein is presently preferred, however, it is contemplated that further variations and modifications within the purview of those skilled in the art can be made herein. As one example, a selectively addressable control grid may be inserted within the lamp envelope to improve light output uniformity and control requirements. The lamp envelope may assume an alternate planar configuration such as a square. The following claims are intended to cover all such variations and modifications as fall within the spirit and scope of the invention.

What is claimed is:

1. A planar vacuum fluorescent lamp for illuminating a document at an object plane, the top surface of said lamp placed juxtaposed said object plane, said lamp comprising:

a substantially rectangular transparent lamp envelope, a continuous layer of reflective, conductive material applied to the interior surface of said envelope, said coating being omitted from a first longitudinal strip at the top surface; said first strip defining a document illumination slit, and from a second longitudinal strip at the surface opposite said top surface, said second strip defining an exit window for illumination reflected from the document, a phosphor layer applied over said reflective conductive material, and a plurality of axially extending cathode filaments positioned within the lamp, whereby when said lamp is energized, light reflected from a document in the object plane is directed along an optical path extending through the interior of said lamp exiting the lamp at said exit window.

* * * * *